US008191252B2

(12) United States Patent
Nagafuchi

(10) Patent No.: US 8,191,252 B2
(45) Date of Patent: Jun. 5, 2012

(54) METHOD FOR PRODUCING CYLINDER HEAD AND CYLINDER HEAD

(75) Inventor: Hiroki Nagafuchi, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 805 days.

(21) Appl. No.: 12/282,946

(22) PCT Filed: Mar. 13, 2007

(86) PCT No.: PCT/IB2007/001368

§ 371 (c)(1),
(2), (4) Date: Jan. 23, 2009

(87) PCT Pub. No.: WO2007/105108

PCT Pub. Date: Sep. 20, 2007

(65) Prior Publication Data

US 2009/0165298 A1 Jul. 2, 2009

(30) Foreign Application Priority Data

Mar. 15, 2006 (JP) ..... 2006-070721

(51) Int. Cl.
*B21B 1/46* (2006.01)
*B23P 11/00* (2006.01)

(52) U.S. Cl. ..... 29/888.06; 29/527.5

(58) Field of Classification Search ..... 29/888.06; 164/10, 30, 137; 123/193.5, 193.3
See application file for complete search history.

(56) References Cited

U.S. PATENT DOCUMENTS 2,820,267 A * 1/1958 Leach ..... 164/137
3,302,250 A 2/1967 Flitz
4,875,518 A * 10/1989 Imura et al. ..... 164/119
4,993,227 A 2/1991 Nagura et al.
6,422,294 B1 * 7/2002 Murata et al. ..... 164/113
7,100,671 B2 * 9/2006 Akaba ..... 164/98

FOREIGN PATENT DOCUMENTS

| | | |
|---|---|---|
| EP | 1 536 141 A1 | 6/2005 |
| JP | 63-314320 | 12/1988 |
| JP | 1-182560 | 7/1989 |
| JP | 1-131831 | 9/1989 |
| JP | 2-11824 | 1/1990 |
| JP | 5-79327 | 3/1993 |
| JP | 6-269899 | 9/1994 |
| JP | 7-229446 | 8/1995 |
| JP | 7-293323 | 11/1995 |
| JP | 2709815 | 10/1997 |
| JP | 10-252553 | 9/1998 |
| JP | 2000-34950 | 2/2000 |

* cited by examiner

*Primary Examiner* — Alexander P Taousakis

(74) *Attorney, Agent, or Firm* — Finnegan, Henderson, Farabow, Garrett & Dunner, LLP

(57) ABSTRACT

A core portion (47) that is used to hold an upper water jacket-forming core (45) and a lower water jacket-forming core (46) with a predetermined distance maintained therebetween includes holding core portions (48) and distance maintaining core portions (50). The upper water jacket-forming core (45) and the lower water jacket-forming core (46) are split from each other at the holding core portions (48). Communication passages that provide communication between an upper water jacket and a lower water jacket are formed by the distance maintaining core portions (50).

2 Claims, 4 Drawing Sheets

METHOD FOR PRODUCING CYLINDER HEAD AND CYLINDER HEAD

CROSS-REFERENCE TO RELATED APPLICATIONS

This application is a national phase application of International Application No. PCT/IB2007/001368, filed Mar. 13, 2007, and claims the priority of Japanese Application No. 2006-070721, filed Mar. 15, 2006, the contents of both of which are incorporated herein by reference.

BACKGROUND OF THE INVENTION

1. Field of the Invention

The invention relates to a method for producing a cylinder head, and a cylinder head produced according to the method.

2. Description of the Related Art

Japanese Patent Application Publication No. 1-182560 (JP-A-1-182560) describes an internal combustion engine including a cylinder head in which a two-tiered water jacket is formed. However, this publication provides no description concerning the method for producing such cylinder head.

SUMMARY OF THE INVENTION

The invention provides a method for producing a cylinder head having a two-tiered water jacket formed therein, and a cylinder head produced according to the method.

A first aspect of the invention relates to a method for producing a cylinder head. According to the method, exhaust port-forming cores are arranged between an upper water jacket-forming core and a lower water jacket-forming core, by using a core which is used to form a two-tiered water jacket within a cylinder head. The core includes the upper water jacket-forming core; the lower water jacket-forming core; and a core portion used to hold the upper water jacket-forming core and the lower water jacket forming core with a predetermined distance maintained therebetween. The core portion includes holding core portions and distance maintaining core portions that connect the end portions of the respective holding core portions to the side end portion of the upper water jacket-forming core and the side end portion of the lower water jacket-forming core. The core is split into two portions at the holding core portions. After arranging the exhaust port-forming cores between the upper water jacket-forming core and the lower water jacket-forming core, the cylinder head is molded by pouring molten material into a die used to form the cylinder head with two split portions of each holding core portion held adjacent to each other.

A second aspect of the invention relates to a cylinder head produced by the following method. According to the method, exhaust port-forming cores are arranged between an upper water jacket-forming core and a lower water jacket-forming core, by using a core which is used to form a two-tiered water jacket within a cylinder head. The core includes the upper water jacket-forming core; the lower water jacket-forming core; and a core portion used to hold the upper water jacket-forming core and the lower water jacket forming core with a predetermined distance maintained therebetween. The core portion includes holding core portions and distance maintaining core portions that connect the end portions of the respective holding core portions to the side end portion of the upper water jacket-forming core and the side end portion of the lower water jacket-forming core. The core is split into two portions at the holding core portions. After arranging the exhaust port-forming cores between the upper water jacket-forming core and the lower water jacket-forming core, the cylinder head is molded by pouring molten material into a die used to form the cylinder head with two split portions of each holding core portion held adjacent to each other.

According to a third aspect, in the second aspect of the invention, the cylinder head has an upper water jacket formed by the upper water jacket-forming core, a lower water jacket formed by the lower water jacket-forming core, and communication passages that are formed by the distance maintaining core portions and that provide communication between the upper water jacket and the lower water jacket.

The communication passages that provide communication between the upper water jacket and the lower water jacket are formed by the distance maintaining core portions included in the core portion used to hold the upper water jacket-forming core and the lower water jacket forming core.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE EXAMPLE EMBODIMENT

Figure 1:
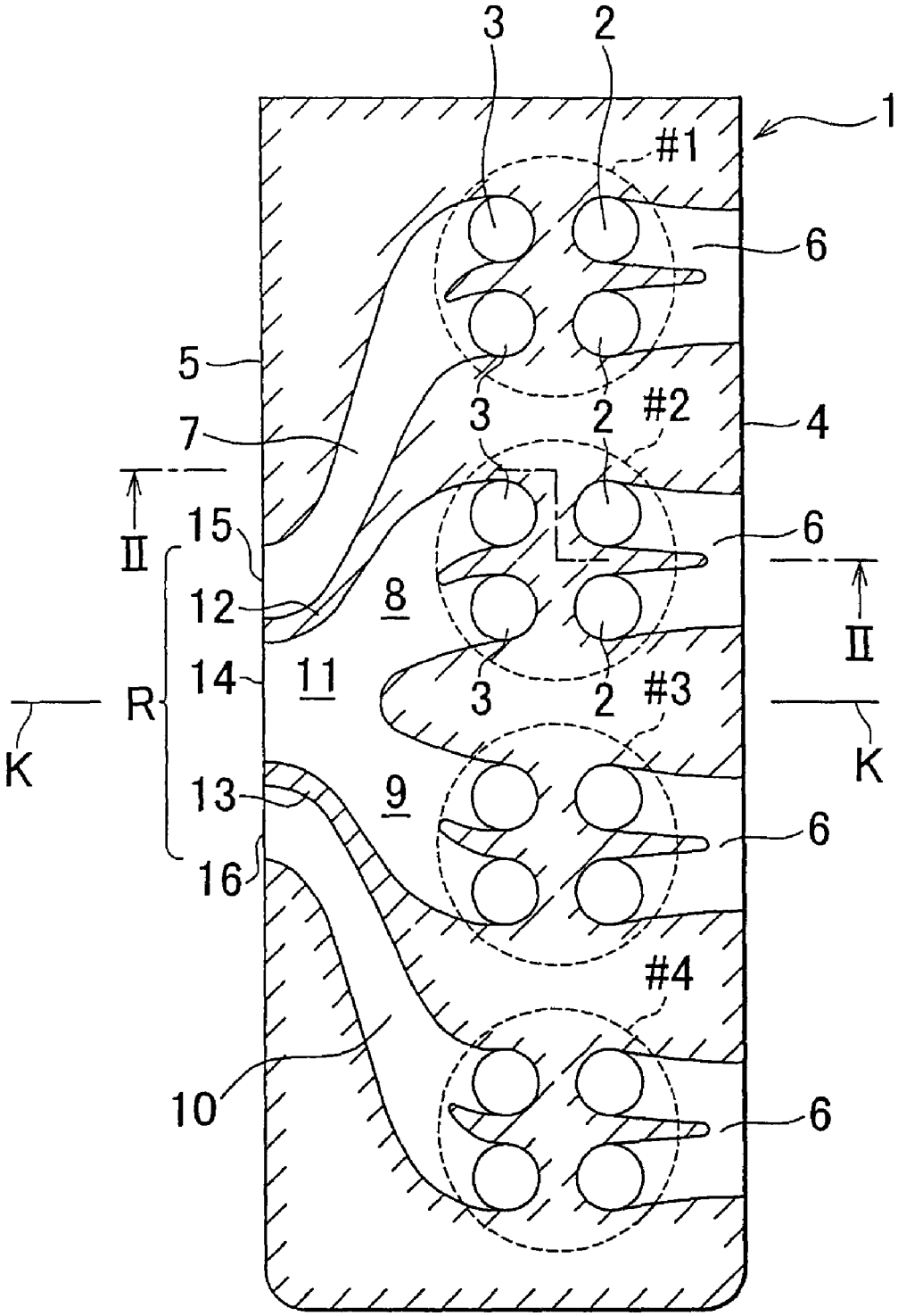
FIG. 1 is the plan cross-sectional view showing a cylinder head.

The alignment of exhaust ports formed in a cylinder head produced by a method according to an embodiment of the invention will first be described. FIG. 1 shows a single-piece cylinder head 1 that is cast in an aluminum alloy. The circles indicated by the dashed lines in FIG. 1 show the arrangement of a first cylinder #1, a second cylinder #2, a third cylinder #3, and a fourth cylinder #4. Accordingly, an internal combustion engine shown in FIG. 1 is an inline four-cylinder internal combustion engine and includes the cylinder head 1. Valve ports 2 in FIG. 1 are opened/closed by respective intake valves, and valve ports 3 in FIG. 1 are opened/closed by respective exhaust valves. As shown in FIG. 1, each of the cylinders #1, #2, #3 and #4 is provided with a pair of intake valves and a pair of exhaust valves.

The cylinder head 1 actually has a coolant passage that extends along a complex path, a portion at which a valve mechanism is supported, a portion in which a spark plug is inserted, a portion in which a fuel injection valve is inserted, etc. formed therein. However, these passage and portions are omitted from FIG. 1.

The cylinder head 1 has side wall faces 4 and 5 that are formed on the opposite sides of the plane including the axes of the cylinders #1, #2, #3 and #4. The side wall faces 4 and 5 extend substantially parallel to this plane. Intake ports 6 of the cylinders #1, #2, #3 and #4 formed within the cylinder head 1 open on the side wall face 4.

Formed within the cylinder head 1 are: an exhaust port 7 of the first cylinder #1, an exhaust port 8 of the second cylinder #2, an exhaust port 9 of the third cylinder #3, and an exhaust port 10 of the fourth cylinder #4. As shown in FIG. 1, each of the exhaust ports 7, 8, 9 and 10 branches off into two portions, at a portion near the corresponding pair of the valve ports 3, while each of the exhaust ports 7, 8, 9 and 10 is formed in a single exhaust port, at a portion slightly apart from these valve ports 3.

As shown in FIG. 1, the exhaust ports of the paired middle cylinders, namely, the exhaust port 8 of the second cylinder #2 and the exhaust port 9 of the third cylinder #3 are joined together within the cylinder head 1 so as to form a joint exhaust port 11, and the joint exhaust port 11 extends to the side wall face 5 of the cylinder head 1. Hereafter, the plane that extends through the center portion between the second cylinder #2 and the third cylinder #3 in the axial direction of the cylinders and that is perpendicular to the plane including the axes of the cylinders #1, #2, #3 and #4 will be referred to as the symmetry plane K-K. The exhaust port 8 of the second cylinder #2 and the exhaust port 9 of the third cylinder #3 are arranged symmetrically with respect to the symmetry plain K-K. The joint exhaust port 11 extends along the symmetry plane K-K to the side wall face 5 of the cylinder head 1.

The exhaust ports of the paired end cylinders, namely, the exhaust port 7 of the first cylinder #1 and the exhaust port 10 of the fourth cylinder #4 are also arranged symmetrically with respect to the symmetry face K-K. The exhaust port 7 of the first cylinder #1 extends from the first cylinder #1 toward the joint exhaust port 11. Then, on one side of the joint exhaust port 11, the exhaust port 7 extends along the joint exhaust port 1 to the side wall face 5 of the cylinder head 1 while the exhaust port 7 and the joint exhaust port 11 are separated from each other by a thin wall 12. Similarly, the exhaust port 10 of the fourth cylinder #4 extends from the fourth cylinder #4 toward the joint exhaust port 11. Then, on the other side of the joint exhaust port 11, the exhaust port 10 extends along the joint exhaust port 11 to the side wall face 5 of the cylinder head 1 while the exhaust port 10 and the joint exhaust port 11 are separated from each other by a thin wall 13.

As shown in FIG. 1, the lengths of the thin walls 12 and 13 that extend along the exhaust ports 7 and 10 are greater than the diameters of the exhaust ports 7 and 10, respectively. As shown in FIG. 1, the exhaust port 7 of the first cylinder #1 and the exhaust port 10 of the fourth cylinder #4 open on the side wall face 5 of the cylinder head 1. An opening 15 of the exhaust port 7 and an opening 16 of the exhaust port 10 are formed on the respective sides of an opening 14 of the joint exhaust port 11.

In the embodiment of the invention, the firing order of the cylinders in the internal combustion engine is #1→#3→#4→#2 or #1→#2→#4→#3. In either of these orders, a pair of the cylinders in which the respective power strokes take place with one intervening power stroke therebetween is a pair of the middle cylinders, namely, the second cylinder #2 and the third cylinder #3 (an intervening power stroke takes place between the power strokes of the second cylinder #2 and the third cylinder #3). Another pair of such cylinders is a pair of the end cylinders, namely, the first cylinder #1 and the fourth cylinder #4 (an intervening power stroke takes place between the power strokes of the first cylinder #1 and the fourth cylinder #4). In this case, if all the exhaust ports are joined together within the cylinder head 1, positive pressure produced in the exhaust port of one cylinder during the exhaust stroke is applied to the exhaust port of another cylinder, where the power stroke subsequently takes place, during the exhaust stroke. This hampers a smooth discharge of the burned gas from a combustion chamber.

In contrast, according to the embodiment of the invention, the exhaust ports of only the cylinders, in which the respective power strokes take place with one intervening power stroke therebetween, are joined together, namely, the exhaust port 8 of the second cylinder #2 and the exhaust port 9 of the third cylinder #3 are joined together, and the exhaust port 7 of the first cylinder #1 and the exhaust port 10 of the fourth cylinder #4 are joined together. With this structure, while exhaust gas is discharged through the exhaust port of one cylinder during the exhaust stroke, positive pressure produced in the exhaust port of another cylinder is not applied to the exhaust port of the one cylinder. As a result, the burned gas is smoothly discharged from the combustion chamber. Namely, interference of the exhaust gas discharged from the different exhaust ports is prevented, which makes it possible to discharge the exhaust gas with high degree of efficiency.

The exhaust gas flows through the opening 14 of the joint exhaust port 11 during only the exhaust stroke of every other cylinder, instead of during the exhaust strokes of all the cylinders. This prevents overheating around the opening 14. In addition, the exhaust gas flows through the opening 15 of the first cylinder #1 and the opening 16 of the fourth cylinder #4 only once in one cycle of the corresponding cylinders #1 and #4. Because of this configuration, there is a little chance of overheating around the openings 15 and 16.

The distance from the valve port 3 to the opening 15 and the distance from the valve port 3 to the opening 16, that is, the passage lengths of the exhaust ports 7 and 10 are longer than the passage lengths of the exhaust ports 8 and 9, respectively. Accordingly, the temperature of the exhaust gas flowing through the exhaust ports 7 and 10 decreases by a larger amount than the temperature of the exhaust gas flowing through the exhaust port 11. Therefore, the thin wall 12 formed between the joint exhaust port 11 and the exhaust port 7 and the thin wall 13 formed between the joint exhaust port 11 and the exhaust port 10 are cooled by the exhaust gas flowing through the exhaust port 7 and the exhaust port 10, respectively. This prevents overheating around the opening 14 of the joint exhaust port 11 further reliably.

Figure 2:
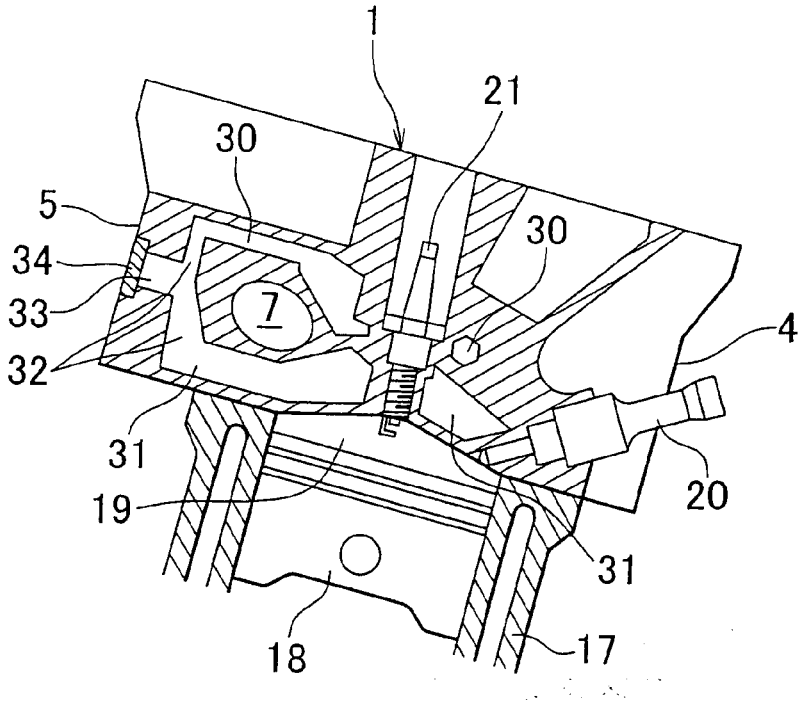
FIG. 2 is the cross-sectional view taken along the line II-II in FIG. 1.

FIG. 2 is the cross-sectional view taken along the line II-II in FIG. 1. FIG. 2 shows a cylinder block 17, a piston 18, a combustion chamber 19, a fuel injection valve 20, and a spark plug 21. As shown in FIG. 2, an upper water jacket 30 and a lower water jacket 31 are formed in the cylinder head 1. The upper water jacket 30 is formed on the upper side of the exhaust ports 7, 8, 9 and 10, and extends in the longitudinal direction and the lateral direction of the cylinder head 1. The lower water jacket 31 is formed on the lower side of the exhaust ports 7, 8, 9 and 10, and extends in the longitudinal direction and the lateral direction of the cylinder head 1.

FIG. 2 shows the state where the internal combustion engine is mounted on a vehicle body. As shown in FIG. 2, according to the embodiment of the invention, the internal combustion engine is mounted on the vehicle body in a manner in which the axes of the cylinders are tilted with respect to the vertical line so that the exhaust-port-side portion of each water jacket is higher than the intake-port-side portion thereof, as a whole, in the vertical direction. A communication passage 32 that extends in the up-and-down direction provides communication between the exhaust-port-side portion of the lower water jacket 31 and exhaust-port-side portion of the upper water jacket 30. The communication passage 32 is connected to the highest end portion of the exhaust-port-side portion of the lower water jacket 31 and the end portion of the exhaust-port-side upper water jacket 30.

Because such communication passage 32 is formed, the air bubbles contained in the coolant in the lower water jacket 31 are guided into the upper water jacket 30, and then discharged to the outside of the cylinder head 1. Accordingly, even if the lower water jacket 31 is tilted, the air does not remain in the exhaust-port-side end portion of the lower water jacket 31. Thus, it is possible to prevent reduction in the cooling efficiency at which the coolant in the water jacket 31 cools the exhaust ports 7, 8, 9 and 10.

Figure 3:
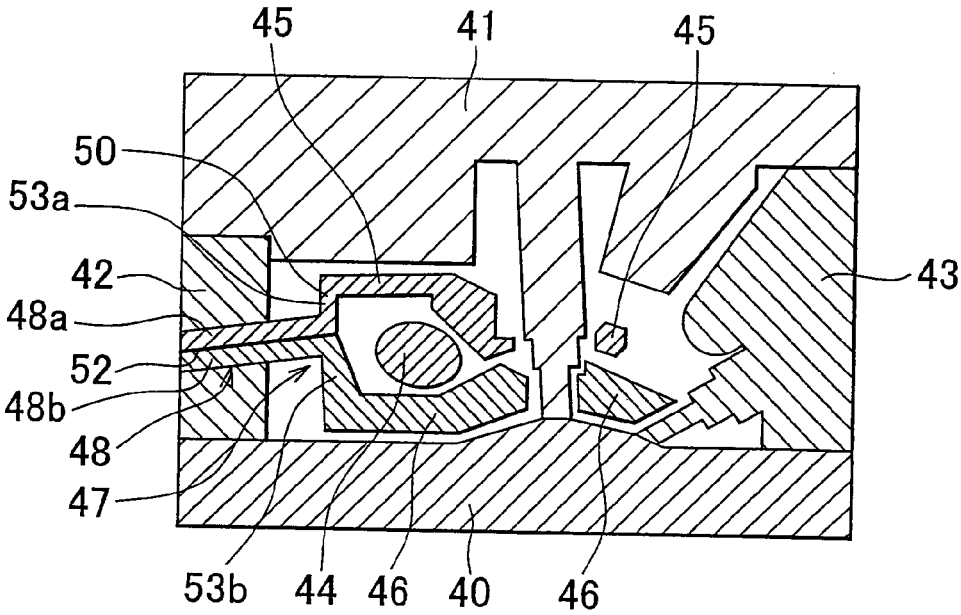
FIG. 3 is the cross-sectional view showing dies and cores used to mold the cylinder head.

Next, a method for producing the cylinder head 1 shown in FIGS. 1 and 2 will be described with reference to FIGS. 3 to 5. FIG. 3 shows dies and cores used to mold the cylinder head 1. FIG. 3 shows a lower die 40, an upper die 41, a side die 42 that is split into two portions, another side die 43, exhaust port forming-cores 44 used to form the exhaust ports 7, 8, 9 and 10, an upper water jacket-forming core 45 used to form the upper water jacket 30, and a lower water jacket-forming core 46 used to form the lower water jacket 31.

Figure 4:
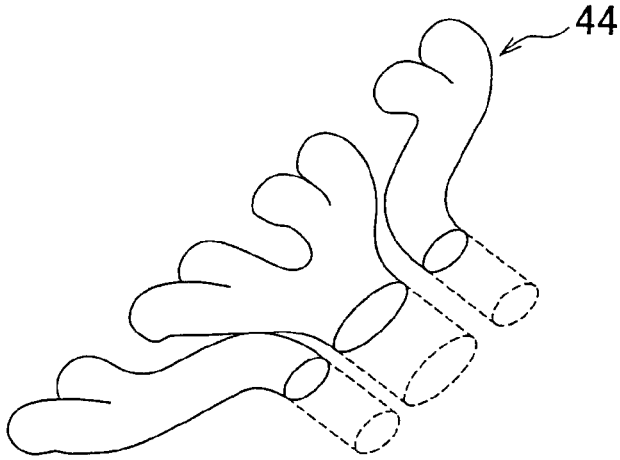
FIG. 4 is the perspective view showing cores used to form exhaust ports.

FIG. 4 is the perspective view of the exhaust port-forming cores 44. FIG. 5 is the perspective view showing the exhaust port-forming cores 44, and upper water jacket-forming core 45 and the lower water jacket-forming core 46 that are arranged so as to surround the exhaust port-forming cores 44. The portions shown by the dashed lines in FIG. 4 show the cores used to hold the exhaust port-forming cores 44 during molding. Although the actual upper water jacket-forming core 45 and the lower water jacket-forming core 46 have considerably complicated structures, theses structures are simplified in FIG. 5.

The structure of the cores used to form the two-tiered water jacket, namely, the upper water jacket 30 and the lower water jacket 31, within the cylinder head 1 according to the embodiment of the invention will be described with reference to FIGS. 3 and 5. A core portion 47 used to hold the upper water jacket-forming core 45 and the lower water jacket forming-core 46 with a predetermined distance maintained therebetween includes holding core portions 48 and 49, and distance maintaining core portions 50 and 51 that connect the end portions of the holding core portions 48 and 49 to the side end portion of the upper water jacket forming-core portion 45 and the side end portion of the lower water jacket-forming core 46. The core portion 47 is split into two portions at the holding core portions 48 and 49.

The surfaces at which the holding core portions 48 and 49 are each split into two portions extend, in the axial direction of the core portions 48 and 49, at the vertical center of the holding core portions 48 and 49, respectively, as shown by the reference numerals 52. Accordingly, as shown in FIG. 3, the holding core portion 48 includes an upper half portion 48*a* and a lower half portion 48*b*. The distance maintaining-core portion 50 includes a connection portion 53*a* that extends from the inner end portion of the upper half portion 48*a* of the holding core portion 48 upward to the end portion of the upper water jacket-forming core 45, and a connection portion 53*b* that extends from the inner end portion of the lower half portion 48*b* of the forming core portion 48 downward to the end portion of the lower water jacket-forming core 46. As shown in FIG. 3, these connection portions 53*a* and 53*b* are stacked on top of each other.

Figure 5:
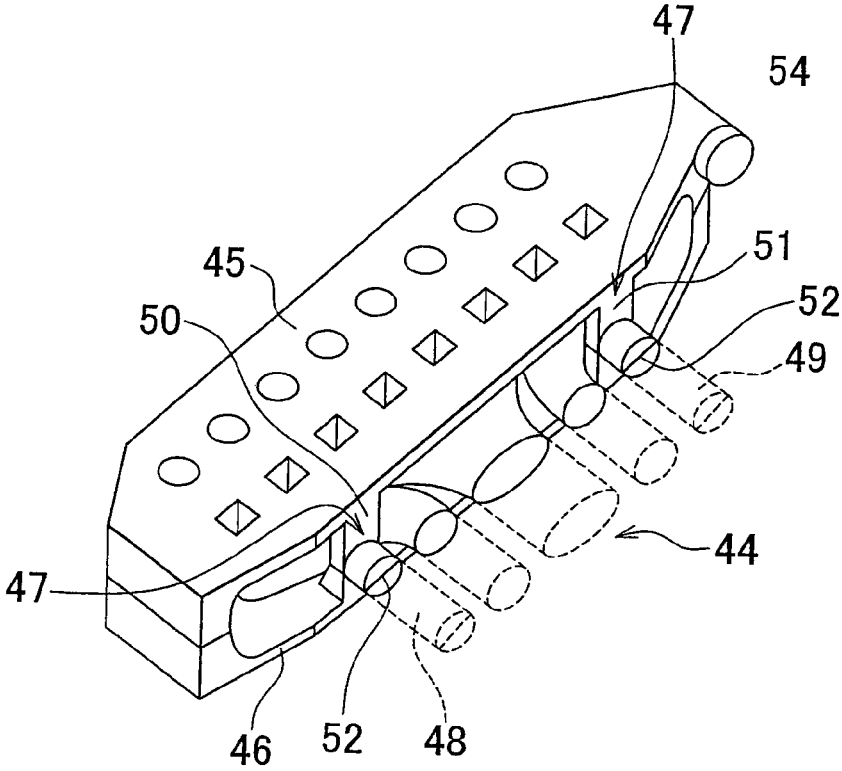
FIG. 5 is the perspective view showing the cores used to form the exhaust ports and cores used to form a two-tiered water jacket.

When the cylinder head 1 is molded, as shown in FIGS. 3 and 5, the exhaust port forming cores 44 are arranged between the upper water jacket forming core 45 and the lower water jacket forming core 46. The upper half portion 48*a* and the lower half portion 48 are stacked in proper alignment to form the holding core portion 48. The holding core portion 48 is held between the two split portions of the side wall 42, while the core holding portions for the exhaust port-forming cores 44 are held. Then, the molten metal is poured into the space defined by the dies and the cores to mold the cylinder head 1.

In this manner, the upper water jacket 30 is formed by the upper water jacket-forming core 45, the lower water jacket 31 is formed by the lower water jacket-forming core 46, and the communication passage 32 that provides communication between the upper water jacket 30 and the lower water jacket 31 is formed by the distance maintaining core portions 50 and 51.

After molding of the cylinder head 1 is completed, the core sand is removed. Then, a passage portion 33 that extends from the communication passage 32 to the side wall face 5 of the cylinder head 1 formed by the holding core portion 48 is obtained. An annular groove is formed at the end of the portion that defines the passage portion 33, on the side of the cylinder head side wall face 5, through a machining process. A cap 34 is fitted in the annular groove, and the end of the passage portion 33, on the side of the cylinder head side wall face 5, is closed by the cap 34.

As shown in FIG. 1, the exhaust ports 7, 8, 9 and 10 open on the cylinder head side wall face 5, and the openings of all the exhaust ports 7, 8, 9 and 10 are formed in the limited region R at the center portion of the cylinder head side wall face 5. As shown in FIG. 5, the distance maintaining core portions 50 and 51 are arranged on the respective sides of the region R, at the positions adjacent to the region R. Accordingly, when molding of the cylinder head 1 is completed, the communication passage 32 is formed on each side of the region R, at the position adjacent to the region R.

With the structure in which the communication passage 32 is formed on each side of the region R, at the position adjacent to the region R, the portion at which the exhaust ports 7, 8, 9 and 10 are gathered is appropriately cooled.

FIG. 5 shows a core portion 54 used to form a coolant outlet through which the coolant is discharged from the cylinder head 1. As shown in FIG. 5, the coolant outlet is formed at the highest position in the water jackets 30 and 31 formed within the cylinder head 1 so that the air bubbles are discharged from the cylinder head 1.

Figure 6:
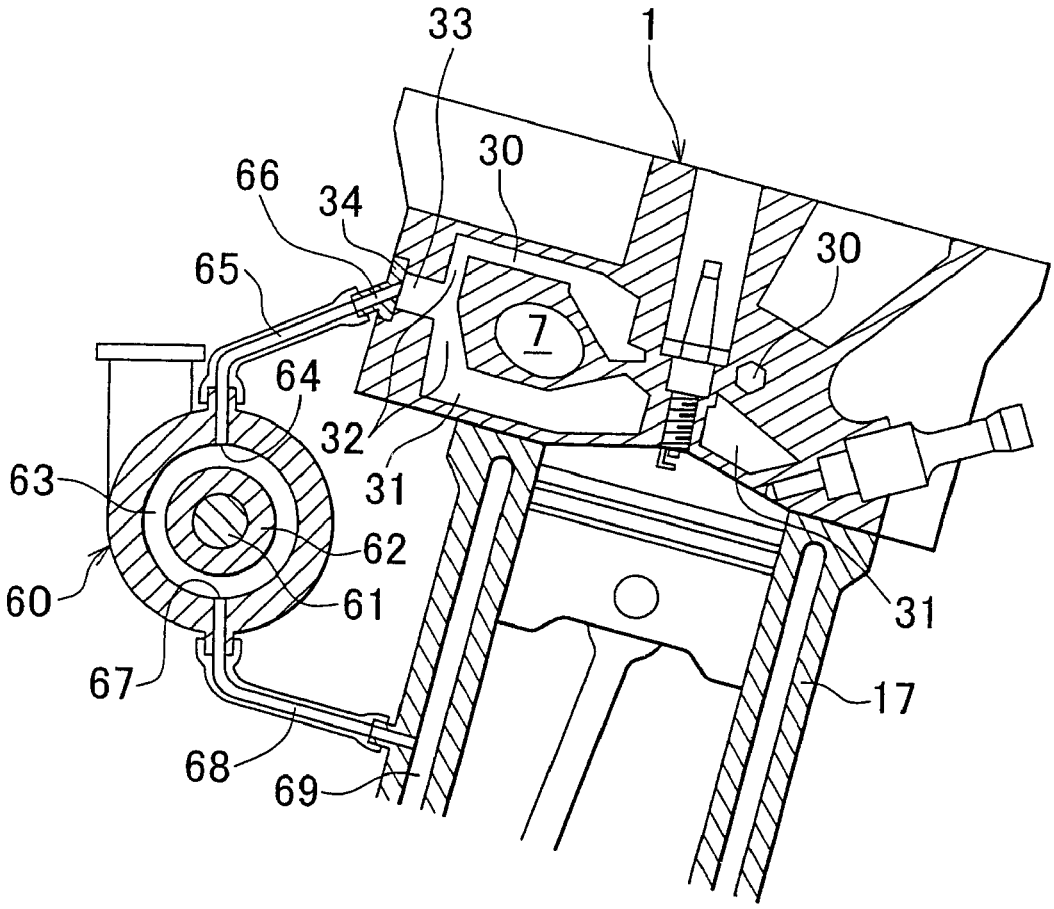
FIG. 6 is the cross-sectional view showing an internal combustion engine.

FIG. 6 is the view used to describe a method for cooling a turbocharger 60 formed of an exhaust turbocharger. FIG. 6 shows a rotating shaft 61 of the turbocharger, a bearing 62, and a water jacket 63 through which coolant for cooling the bearing 62 flows. According to the embodiment of the invention, the water jacket 63 of the turbocharger 60 is formed at a position lower than the water jackets 30 and 31 formed within the cylinder head 1 in the vertical direction, as shown in FIG. 6. A coolant outlet 64 of the water jacket 63 formed within the turbocharger 60 communicates with the water jackets 30 and 31 formed within the cylinder head 1 through a coolant passage 65 that extends upward from the coolant outlet 64.

In this case, as shown in FIG. 6, a coolant inlet 66 is formed in the cap 34, and the coolant passage 65 communicates with the coolant inlet 66. A coolant inlet 67 of the water jacket 63 communicates with a water jacket 69 formed within the cylinder block 17 through a coolant passage 68. In the embodiment of the invention, the coolant in the water jacket 69 of the cylinder block 17 is guided into the water jacket 63 of the turbocharger 60 through the coolant passage 68. Then, the coolant, of which the temperature has been increased due to cooling of the bearing 62, is discharged into the passage portion 33 through the coolant passage 65.

When the internal combustion engine stops, the coolant in the water jacket 63 stops flowing. As a result, the temperature of the coolant in the water jacket 63 increases, and steam is generated. Immediately after being generated, the steam is discharged into the water jacket 30 through the coolant passage 65. Thus, the coolant having a low temperature flows around the bearing 62. As a result, overheating of the bearing 62 is suppressed.

The invention claimed is:

1. A method for producing a cylinder head, comprising:

providing a core which includes:

an upper water jacket-forming core which is used to form an upper water jacket within a cylinder head;

a lower water jacket-forming core which is used to form a lower water jacket within the cylinder head; and a core portion including a holding core portion and a distance maintaining core portion which is used to hold the upper water jacket-forming core and the lower water jacket forming core with a predetermined distance maintained between the upper water jacket-forming core and the lower water jacket forming core, said core portion connects an end portion of the holding core portion to a side end portion of the upper water jacket-forming core and a side end portion of the lower water jacket-forming core, and the core portion being split into two portions at the holding core portion;

arranging an exhaust port-forming core between the upper water jacket-forming core and the lower water jacket-forming core using the core portion; and molding the cylinder head by pouring molten material into a die used to form the cylinder head with two split portions of the holding core portion held adjacent to each other.

2. The method according to claim 1, wherein the holding core portion that is split into the two split portions is held by a side wall of the die used to form the cylinder head.

* * * * *